US006840224B2

(12) United States Patent
Tanabe et al.

(10) Patent No.: US 6,840,224 B2
(45) Date of Patent: Jan. 11, 2005

(54) PRESSURE-ELEVATING TYPE FUEL INJECTING SYSTEM

(75) Inventors: Keiki Tanabe, Tochigi (JP); Susumu Kohketsu, Tokyo (JP); Shinji Nakayama, Tochigi (JP)

(73) Assignee: Mitsubishi Fuso Truck and Bus Corporation, Tokyo (JP)

( * ) Notice: Subject to any disclaimer, the term of this patent is extended or adjusted under 35 U.S.C. 154(b) by 0 days.

(21) Appl. No.: 10/622,691

(22) Filed: Jul. 21, 2003

(65) Prior Publication Data

US 2004/0020465 A1 Feb. 5, 2004

(30) Foreign Application Priority Data

Jul. 30, 2002 (JP) ..... 2002-221330

(51) Int. Cl.[7] ..... F02M 55/02
(52) U.S. Cl. ..... 123/458; 123/447
(58) Field of Search ..... 123/447, 457, 123/458, 459, 463, 456, 445, 446

(56) References Cited

U.S. PATENT DOCUMENTS 6,112,721 A * 9/2000 Kouketsu et al. ..... 123/447
6,192,862 B1 * 2/2001 Tanabe et al. ..... 123/447
6,457,453 B1 * 10/2002 Tanabe et al. ..... 123/300
6,499,465 B1 * 12/2002 Mahr et al. ..... 123/447
6,520,152 B1 * 2/2003 Mahr et al. ..... 123/447

* cited by examiner

*Primary Examiner*—Mahmoud Gimie
(74) *Attorney, Agent, or Firm*—Birch, Stewart, Kolasch & Birch, LLP

(57) ABSTRACT

A pressure-elevating type fuel injecting system selectively injects via injectors fuel stored in a common rail or fuel whose pressure is elevated by a pressure elevating mechanism into a combustion chamber, and comprises a crank angle sensor producing crank pulse signals in accordance with operating states of an engine, a pulse interval calculating unit calculating pulse intervals between respective crank pulse signals, and a determination unit determining the malfunction of the pressure elevating mechanism when a variation of the pulse interval is above a determination threshold.

11 Claims, 7 Drawing Sheets

FIG. 4

DETERMINATION OF DETAILS MALFUNCTIONS

| | EXCESSIVE CONSUMPTION OF RAIL-STORED FUEL (Flgb) | INADEQUATE CONSUMPTION OF RAIL-STORED FUEL (Flga) |
|---|---|---|
| EXCESSIVE FUEL INJECTION (FlgA) | ABNORMAL PRESURE-FEEDING OF FUEL BY PRESSURE ELEVATING PISTON | |
| INADEQUATE FUEL INJECTION (FlgB) | EXCESSIVE FUEL LEAKAGE<br><br>MALFUNCTION OF PRESSURE ELEVATING PISTON | MALFUNCTION OF PRESSURE ELEVATING PISTON |

FIG. 5(A)

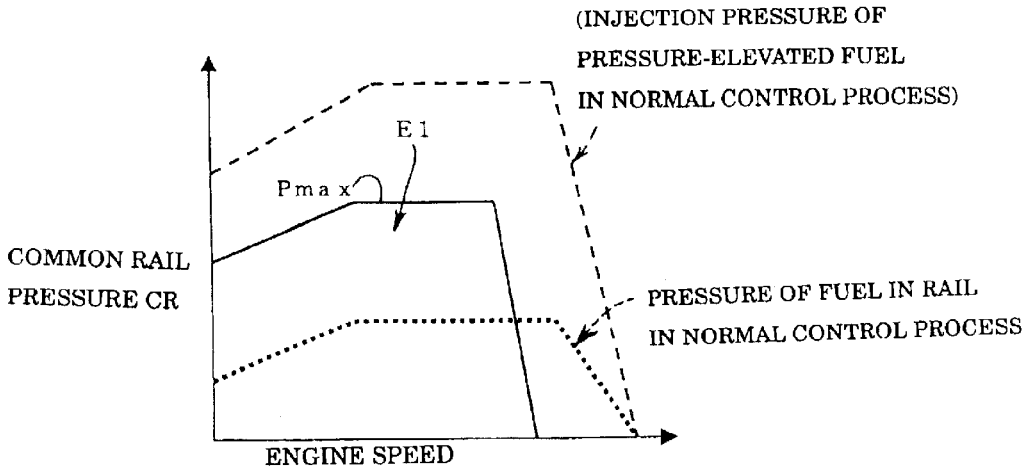

PRESSURE-ELEVATING TYPE FUEL INJECTING SYSTEM

FIELD OF THE INVENTION

This invention relates to a pressure-elevating type fuel injecting system in which high pressure fuel from a pressure accumulating chamber is further pressurized by a pressure elevating mechanism and is injected into combustion chambers via injectors, and more particularly to a pressure-elevating type fuel injecting system which can precisely inject fuel even when the pressure elevating mechanism is malfunctioning.

DESCRIPTION OF THE RELATED ART

A pressure-elevating type fuel injecting system is one of fuel injecting systems which inject fuel to combustion chambers of an internal combustion engine via injectors. In such a pressure-elevating type fuel injecting system, high pressure fuel from a fuel supply is stored in common rail functioning as a pressure accumulating chamber constituted, and injector nozzles coupled to the common rail face with the combustion chambers. Further, a pressure elevating mechanism is disposed in a branch of a high pressure fuel supply path extending between the common rail and the injectors. In the pressure-elevating mechanism, a power piston is actuated by pressure of the high pressure fuel applied via the branch of the high pressure fuel path, and feeds the pressurized fuel to the injectors. In short, the power piston is operated by a pressure elevating piston electromagnetic valve. For instance, the pressure-elevating type fuel injecting system operates as shown in FIG. 9 of the accompanying drawings. Specifically, fuel injection is started when a signal S1 for actuating an injector electromagnetic valve is issued at a timing ta. Pressure Pc at the common rail is elevated when a signal S2 for actuating the pressure-elevating piston electromagnetic valve (called the "piston electromagnetic valve") is issued at a timing tb. Further, the pressurized fuel has a time-dependent pressure variation as shown by Ph, and is injected with a fuel injection ratio M1.

Fuel injection is carried out in two steps. Specifically, an initial fuel injection j1 is performed between the timing ta (at which the injector electromagnetic valve is opened) and the timing tb (at which the piston electromagnetic valve is opened), and a final fuel injection j2 is performed between the timing tb and a timing tc at which the injector electromagnetic valve is closed. This measure has been taken in order to reduce exhaust gases and engine noise.

In the pressure elevating type fuel injecting system, a metering valve is provided in a fuel return path of a fuel injection pump which supplies high pressure fuel to the pressure accumulating chamber. Further, the pressure elevating mechanism includes fuel pressure control members such as electromagnetic valves, power pistons, and orifices in branches. The electromagnetic valves turn on or off the pressure elevating mechanism. Appropriate operations of these control units enable the pressure-elevating type fuel injecting system to selectively inject fuel stored in the pressure accumulating chamber or pressure-elevated fuel to the combustion chambers via the injectors. However, the control members tend to malfunction due to aging and so on.

For instance, the malfunction of the power pistons may cause non-smooth or inadequate pressure-feeding of fuel, torque variations, and insufficient purification of exhaust gases.

If a feed rate regulating orifice, which is disposed in series with the pressure elevating mechanism electromagnetic valve in a return path, happens to be cracked or broken, the power piston may cause excessive pressure, which may result in excessive pressure-feeding of fuel. This will lead to torque variations, emission of black smoke, or breakdown of high pressure systems due to pressures above allowable limits.

Further, if a power piston wears, it fails to operate appropriately, and causes leakage of fuel. As a result, pressure-elevated fuel cannot be smoothly fed. Insufficient pressure-feeding of fuel may lead to torque variations and inadequate purification of exhaust gases. Still further, the increase of returned fuel may prevent sufficient control of the common rail pressure.

Besides, if a pressure-elevating mechanism electromagnetic valve does not properly function, returned fuel may leak, the power piston cannot stop reliably and produce excessive pressure, and excessive pressure-feeding of fuel may be caused. These phenomenon may result in torque variations and black smoke.

Japanese patent laid-open publication No. Hei 5-141,301 describes a troubleshooting device for a pressure-elevating type fuel injecting system of a multiple-cylinder engine. The troubleshooting device downloads physical fuel pressure values of respective cylinders, and locates a cylinder whose pressure-elevating type fuel injection system is malfunctioning whenever such a cylinder has a physical value deviated from the average by a preset amount. However, the troubleshooting device can only detect an abnormal cylinder but cannot determine whether fuel pressure control members, control units or other parts are malfunctioning. This means that it is somewhat troublesome to take appropriate measures in an emergency, which may damage the engine or a vehicle.

SUMMARY OF THE INVENTION

In order to overcome problems of the related art, the present invention aims at providing a pressure-elevating type fuel injecting system which can quickly determines whether or not a pressure elevating mechanism is malfunctioning and avoid malfunctions of an engine or a vehicle.

There is provided a pressure-elevating type fuel injecting system in which high pressure fuel from a pressure accumulating chamber is further pressurized by a pressure-elevating mechanism and is injected into combustion chambers by injectors. The pressure-elevating type fuel injecting system comprises: a crank angle sensor producing crank pulse signals in accordance with operating states of an engine; a pulse interval calculating unit calculating pulse intervals between the respective crank pulse signals; and a determination unit determining that the pressure elevating mechanism is malfunctioning when variations of the pulse intervals exceed a determination threshold.

With the invention, the pressure elevating mechanism is easily determined to be malfunctioning if the crank pulse interval depending upon the operating states of the engine is found to be abnormal. Further, it is possible to protect the engine against vibrations and prevent insufficient purification of exhaust gases.

BRIEF DESCRIPTION OF THE DRAWINGS

FIG. 4 shows details of malfunctions.

FIG. 5(A) shows control characteristics of common rail pressure and engine speed, used for the pressure-elevating type fuel injecting system to perform troubleshooting.

DETAILED DESCRIPTION OF THE INVENTION

Figure 1:
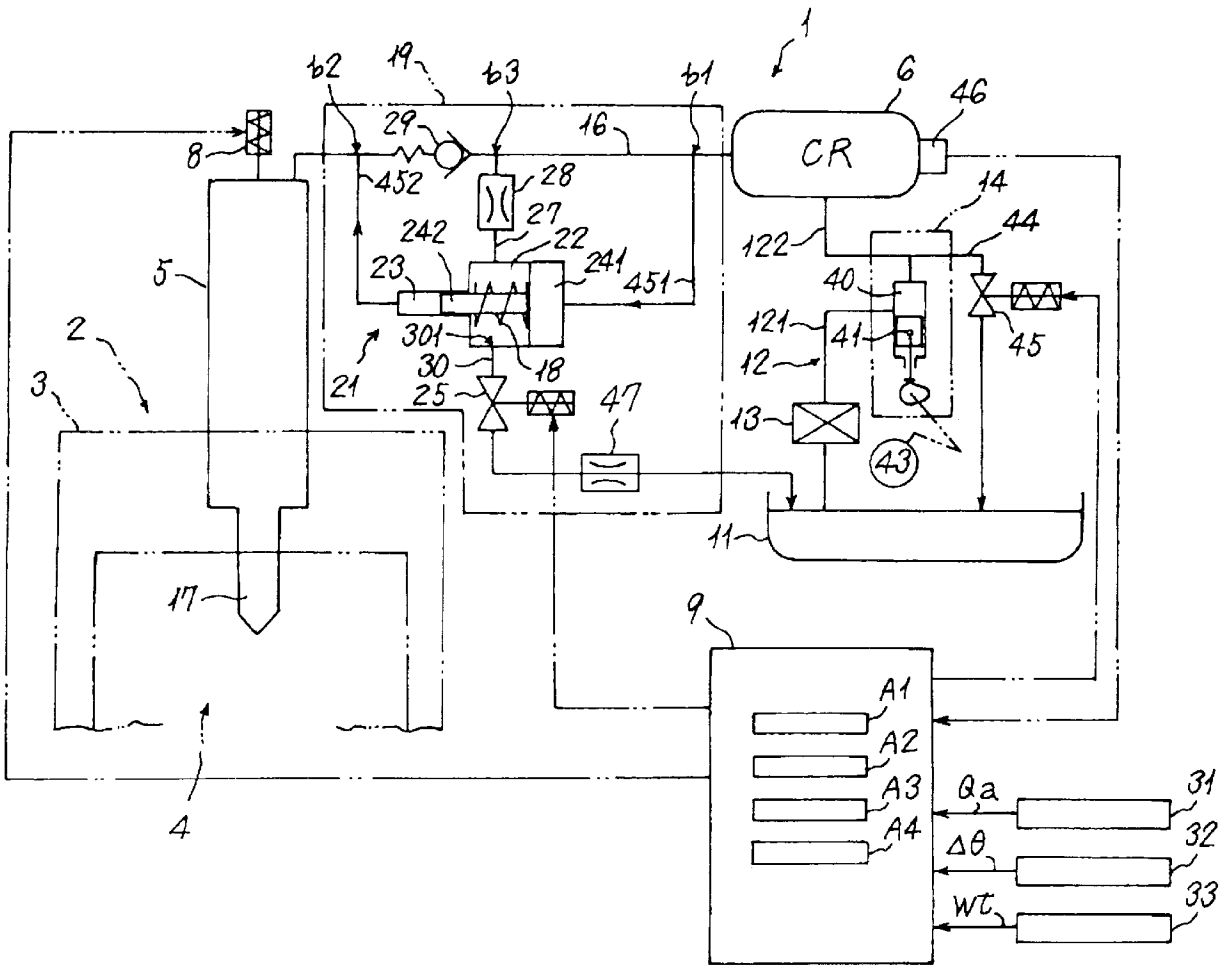
FIG. 1 is a schematic diagram of a pressure-elevating type fuel injecting system and an engine to which the pressure-elevating type fuel injecting system is applicable.
Figure 2:
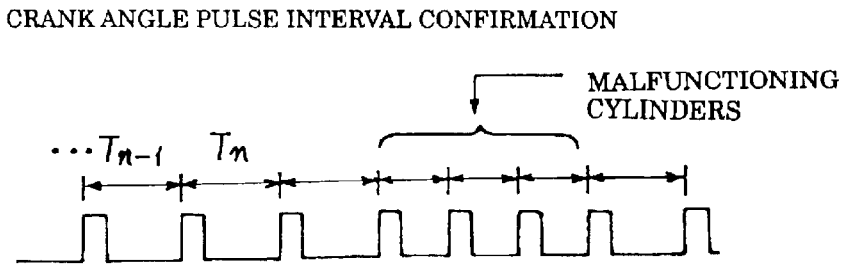
FIG. 2 describes confirmation of crank angle pulse intervals in the pressure-elevating type fuel injecting system of FIG. 1.

The invention will be described with reference to one embodiment shown in FIG. 1 to FIG. 3.

A pressure-elevating type fuel injecting system 1 is installed in a multiple cylinder diesel engine 2 (called the "engine 2"), not shown. Specifically, the pressure-elevating type fuel injecting system 1 (called the "fuel injecting system 1") is mounted on an engine body 3 of the engine 2, and injects pressurized fuel to combustion chambers 4 in the engine body 3, in a two-step injection mode M1 or a single step injection mode M2 as described later.

The fuel injection system 1 comprises: injectors 5 injecting fuel to each combustion chamber 4 in the engine body 3; a common rail 6 supplying high pressure fuel to the injectors 5; a high pressure fuel source 7 feeding the high pressure fuel to the common rail 6; and an engine controller 9 controlling the operation of injector electromagnetic valves 8 of the injectors 5.

The high pressure fuel source 7 includes a fuel tank 11, a supply pipe 12 via which the high pressure fuel is pressure-fed to the common rail 6, and a fuel pump 14 provided on the supply pipe 12, pressurizing the fuel from the fuel tank 11 via a filter 13 and pressure-feeding the fuel.

The fuel pump 14 includes in its body a plunger chamber 40 communicating with a cylinder, and a plunger 41 functioning in the plunger chambers 40. Each plunger 41 is activated by a pump camshaft 42 and a crankshaft 43 of the engine via a rotation transmission (not shown).

The plunger chamber 40 connects to an inlet 121 and an outlet 122 of the supply pipe 12, and a return path 44. The return path 44 is opened and closed by a metering valve 45 at a preset duty ratio DR.

An amount of fuel in the return path 44 is controlled, so that a pressure of high pressure fuel in the common rail 6 or the pressure accumulating chamber is adjusted to a target fuel pressure, i.e. a target rail pressure pcr.

The common rail 6 is supported to the engine body 3 in a direction extending along the cylinders (in a plane which is perpendicular to the plane of the drawing sheet), stores high pressure fuel from the fuel supply pipe 12, and branches a main injection path 16 at a position facing with the injectors 5. Further, the common rail 6 includes a fuel pressure sensor 46 producing a fuel pressure signal Pc of the high pressure fuel, which is transmitted to the controller 9.

The injectors 5 are identically structured. Each injector 5 includes a nozzle 17 and an injector electromagnetic valve 8, and is connected to a fuel pressure regulating section 19. The nozzle 17 is attached to the engine body 3 in order to inject the fuel into the combustion chamber 4. The injector electromagnetic valve 8 is opened or closed in response to an actuation signal from the controller 9, thereby enabling the high pressure fuel to be injected into the combustion chamber 4 via the main injection path 16 and the nozzle 17.

The fuel pressure regulating section 19 includes the main injection path 16, from which a pressure-elevating mechanism 21 is branched. The pressure-elevating mechanism 21 is provided with large and small cylinder chambers 22 and 23 which are in parallel with the main injection path 16. The cylinder chambers 22 and 23 house large and small pressurizing pistons 241 and 242. The pistons 241 and 242 are either constituted by one cylinder or two cylinders. The large cylinder chamber 22 communicates with an upstream branch b1 (near the common rail) via an upstream side 451 while the small cylinder chamber 23 communicates with a downstream branch b2 (near the injector) via a downstream side 452.

The large cylinder chamber 22 also communicates with a pressure releasing path 30 via a part thereof near the small cylinder chamber 23, and with a pressure regulating path 27. The pressure releasing path 30 includes a pressure elevating mechanism electromagnetic valve 25 which releases the fuel pressure in the large cylinder chamber 22. The pressure regulating path 27 communicates with an intermediate branch b3 of the main injection path 16 via a throttle 28.

Further, a check valve 29 is provided between the downstream branch b1 and intermediate branch b3 in order to prevent the fuel from flowing to the common rail 6 from the injector 5.

The large cylinder chamber 22 has its opening 301 communicating with the fuel tank 11 via an open path 30. The pressure elevating electromagnetic valve 25 is provided between the opening 301 and the open path 30. A flow controlling orifice 47 is positioned in the open path 30 in order to control a feed rate of high pressure fuel emitted from the large cylinder chamber 22, and regulate pressure elevating speeds of pressure elevating pistons 241 and 242.

The pressure-elevating mechanism electromagnetic valve 25 is opened or closed in response to an actuation signal from the controller 9, and opens or closes the pressure releasing path 30 and the large cylinder chamber 22. As a result, a pressure difference is produced on the front and rear surfaces of the pressurizing piston 241, which is moved to the left by pressure (as shown in FIG. 1), and elevates the pressure of the fuel at the downstream branch b2.

The controller 9 has a number of ports in its input and output circuits, to which various sensors are connected in order to collect operating state data of the engine 2. Specifically, the sensors are an accelerator pedal depression sensor 31 detecting an accelerator pedal depression θ a of the engine 2, a crank angle sensor 32 collecting crank angle pulses including a cylinder-determining signal from a rotor integral with the crankshaft 43, and a water temperature sensor 33 detecting a water temperature wt. The crank angle pulses are sequentially stored by the controller 9 in chronological order, and are used to sequentially calculate intervals Tn between previous and current crank angle pulses (see FIG. 2), and to derive an engine speed Ne.

The controller 9 functions not only as an ordinary engine controller but also serves for the fuel injecting system 1 as an injection control unit A1, a pulse interval calculating unit A2, an opening-closing signal deviation calculating unit A3, and a determination unit A4.

Figure 9:
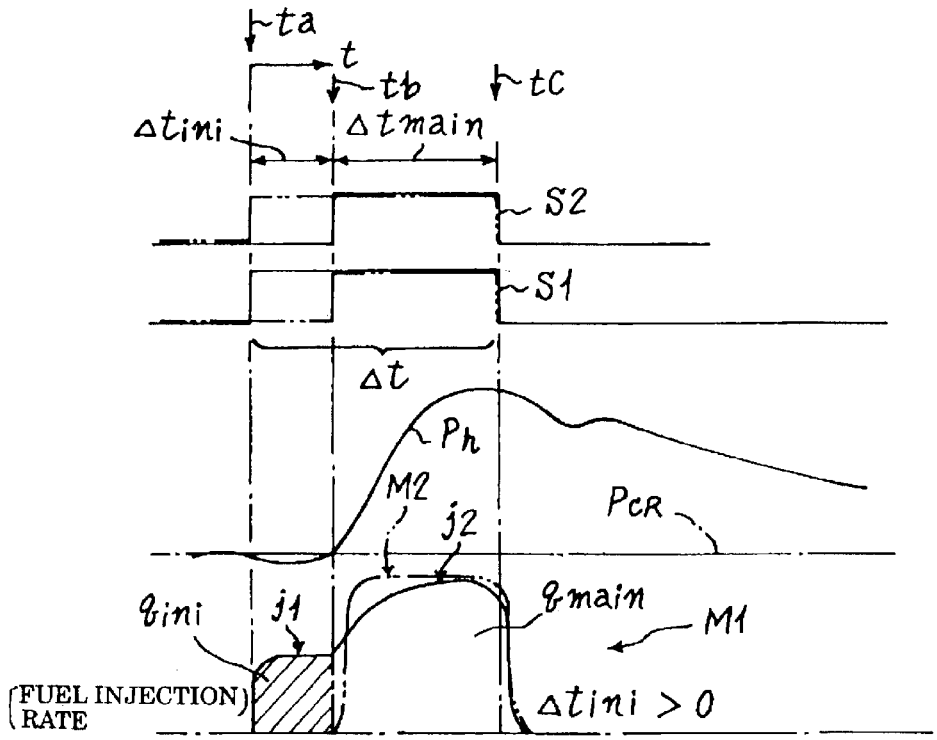
FIG. 9 shows an injection rate of a fuel injecting system.
Figure 10:
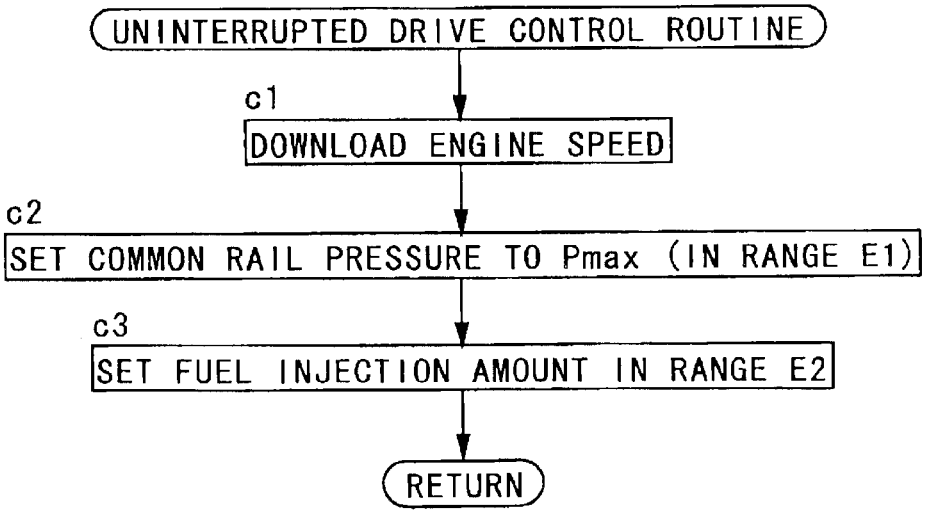
FIG. 10 is a flowchart of a control routine for uninterrupted driving.

Referring to FIG. 9, the fuel injecting system 1 initiates the fuel injection at a valve opening timing ta at which a signal s1 for actuating the injector electromagnetic valve 18 is issued. Pressure of the fuel at the downstream branch b2 of the main injection path 16 is elevated at a valve opening timing tb at which a signal s2 for actuating the pressurizing electromagnetic valve 25 is issued. The fuel pressure varies with time as shown by Ph in FIG. 2. The controller 9 controls the fuel injecting system 1 in order that the fuel injection is executed in the two-step injection mode M1 or in the single step injection mode M2.

In the two-step injection mode M1, the fuel injection is carried out in two steps, i.e. the initial fuel injection j1 is performed between the opening timing ta of the injector electromagnetic valve 8 and the opening timing tb, and a final fuel injection j2 is carried out between the opening timing tb of the pressurize-elevating mechanism electromagnetic valve 25 and the closing timing tc of the injector electromagnetic valve 8. This is effective in preventing abrupt increase of the cylinder pressure, accomplishing appropriate fuel state, and reducing Nox, PM and fuel consumption.

The injection control unit A1 calculates a target fuel injection quantity using a target fuel injection quantity map (not shown) in accordance with an engine speed Ne and an accelerator pedal depression. Either the two-step or single step injection mode M1 or M2 will be selected in accordance with the engine speed Ne and accelerator pedal depression.

The injection control unit A1 calculates a time difference (initial fuel injection period) $\Delta_{tini}$ on the basis of the open timing ta of the injector electromagnetic valve 8, which switches the fuel injection over to the non-fuel injection of via the injectors or vice versa, and the open timing tb of the pressure elevating electromagnetic valve 25 turning on or off the pressure elevating mechanism 21. A time difference map (not shown) is used for this calculation. Thereafter, the injection controlling unit A1 sets a final injection period $\Delta_{tmain}$, which assures the target fuel injection amount, taking the time difference $\Delta_{tini}$ into consideration. Further, an injector opening period Δt is calculated by adding the final injection period $\Delta_{tmain}$ and the time difference $\Delta_{tini}$. The foregoing description is also applicable to the single step injection mode M2.

The pulse interval calculating unit A2 calculates the pulse interval Tn between adjacent crank angle pulses. The crank angle pulses are chronologically stored in the controller 9. Further, the pulse interval Tn (see FIG. 2) between the previous crank angle pulse and the current crank angle pulse θ n is chronologically stored.

The opening-closing signal deviation calculating unit A3 calculates a duty ratio deviation δ D between the duty ratio DR, which is actually an opening/closing signal for the metering valve 45, and a basic duty ratio DR α which is a basic opening/closing signal corresponding to the target fuel pressure of the common rail 6.

The determination unit A4 determines that the pressure elevating mechanism 21 is malfunctioning when a variation δ t of the pulse interval Tn is above a threshold δ ta and the duty ratio deviation δ D of the duty ratio DR is above an allowable duty ratio deviation δ Da.

The operation of the fuel injecting system of FIG. 1 will be described with reference to the control operation of the controller 9.

When the engine 2 of a vehicle (not shown) is activated, the controller 9 starts to control the engine 2, i.e. receives self-check results of devices operating in the fuel injecting system and fuel supply system, and sensors so on. The controller 9 checks whether or not the received self-check results are normal, and sequentially controls the fuel injection process, troubleshooting process, and other processes.

In the fuel injection controlling process, the following are performed: calculation of the target fuel injection amount; selection of either the two-step fuel injection mode M1 or the single step fuel injection mode M2; and calculation of the opening timing ta of the injector electromagnetic valve 8 and the opening timing tb of the pressure-elevating electromagnetic valve 25; the time difference $\Delta_{tini}$; and the final injection period $\Delta_{tmain}$ and the injector opening timing Δt.

Thereafter, data concerning the opening timings ta and tb of electromagnetic valves 8 and 25, and closing timing tc of the electromagnetic valves 8 and 25 are set in a fuel injection driver (not shown). In response to a unit crank signal δ θ, the fuel injection driver counts the opening timings ta and tb for the injector electromagnetic valve 8 and pressure-elevating electromagnetic valves 25, respectively, and the closing timing tc for the electromagnetic valve 8 and 25. Upon counting the foregoing timings, the fuel injection driver emits a valve switching output, so that the injectors 5 are operated in either the two-step or single step injection mode M1 or M2.

A troubleshooting routine is executed in a main routine of the engine control process.

Figure 6:
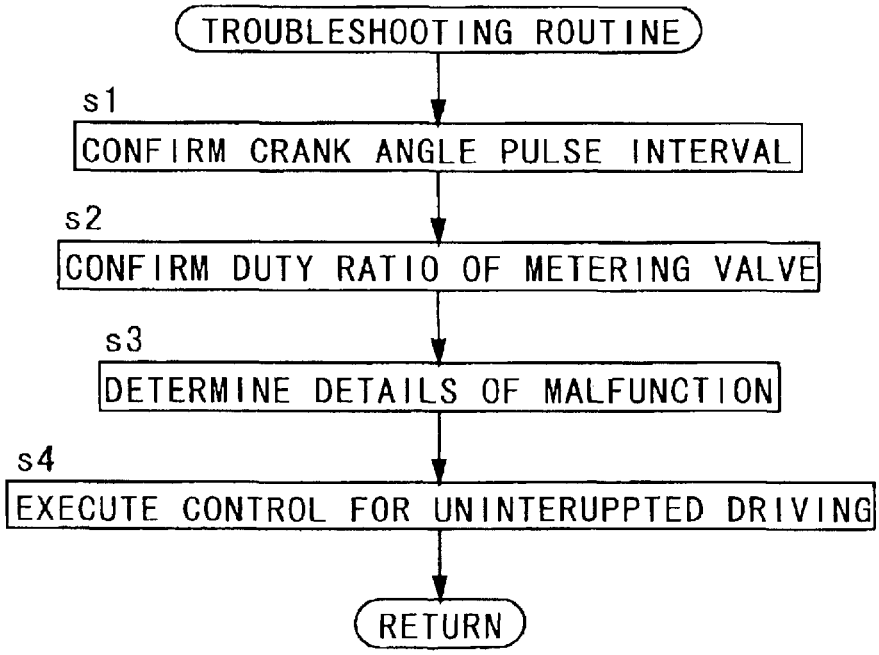
FIG. 6 is a flowchart of a troubleshooting routine in the pressure-elevating type fuel injecting system of FIG. 1.

Referring to FIG. 6, the crank angle pulse interval is confirmed in step s1, and the duty ratio of the metering valve 45 is confirmed in step s2. In step s3, troubleshooting is executed, and control for uninterrupted drive is executed in step s4.

Figure 7:
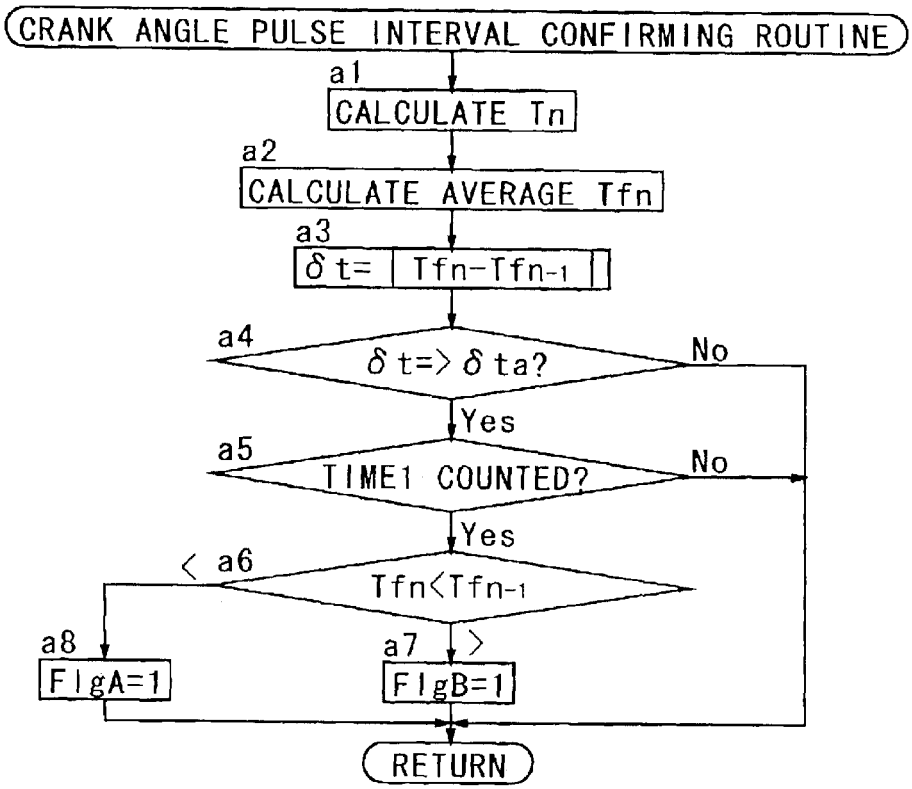
FIG. 7 is a flowchart of a crank angle pulse interval confirming routine.

In step a1 of a crank angle pulse confirming routine shown in FIG. 7, the controller 9 sequentially calculates and stores the pulse intervals Tn between adjacent crank angle pulses, i.e. the previous and current crank angle pulses. In other words, the controller 9 chronologically stores the crank angle pulses. The pulse interval Tn denotes an interval between adjacent pulse signals applied to the respective cylinders.

Next, in step a2, an average Tf of the current pulse interval Tn, previous pulse interval and last but one pulse interval is calculated, {e.g. (Tn−2+Tn−1+Tn)/3}. The current, previous and last but one pulse intervals are forwarded and updated in every control cycle. Further, the current average Tfn is also updated. Still further, the existing average is replaced by the current average Tfn, and serves as the previous average Tfn−1.

In step a3, a variation δ t of the pulse interval Tn (=|Tfn−(Tfn−1)|) is calculated on the basis of the current average Tfn and the previous average Tfn−1. In step a4, it is checked whether or not the pulse interval variation δ t exceeds a determination threshold δ ta.

If the pulse interval variation δ t is smaller than the determination threshold δ ta and varies slightly, the control process in step a3 is completed. Otherwise, if δ t is larger than δ ta, the control process proceeds to step a5. After δ t is larger than δ ta for a preset Time 1, the control process proceeds to step a6.

In step a6, the current average Tfn is compared with the previous average Tfn−1. When Tfn<Tfn−1, the engine is considered to be accelerating. In step a7, it is determined that excessive fuel tends to be injected, so that a trouble flag FlgA is set to "1". On the other hand, when Tfn>Tfn−1, the engine is considered to be decelerating. In step a8, fuel injection is determined to be inadequate, so that the trouble flag FlgB is set to "1". Thereafter, the control process returns to step a2 (in the troubleshooting routine).

Figure 8:
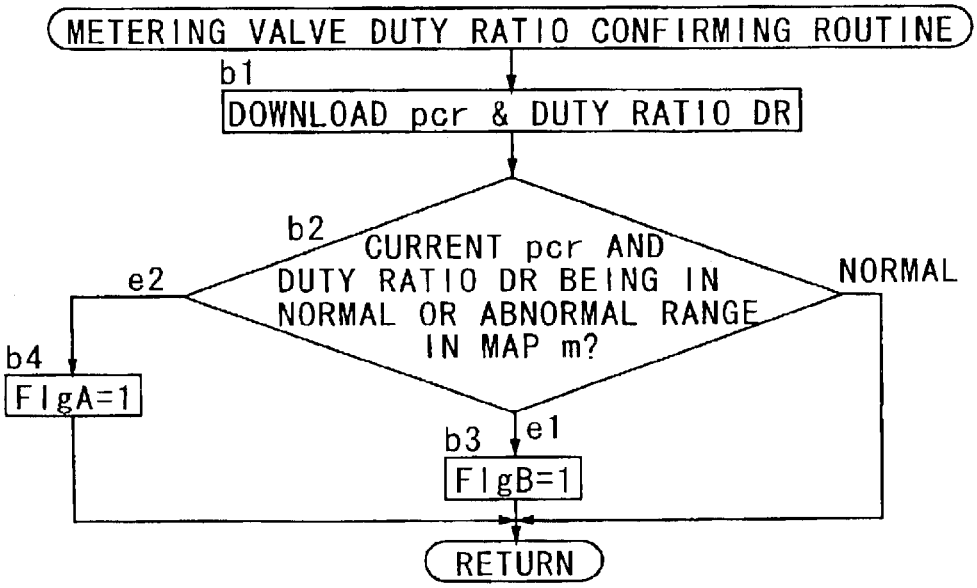
FIG. 8 is a flowchart of a metering valve duty ratio confirming routine.

Referring to FIG. 8, when the process proceeds to step b1 of the metering valve duty ratio confirming routine, the controller 9 downloads the target rail pressure pcr which is a target pressure of high pressure fuel, and the duty ratio DR which is an opening/closing signal of the metering valve 45. The duty ratio DR is set in the injection controlling routine in accordance with an operating state of the engine 2.

Figure 3:
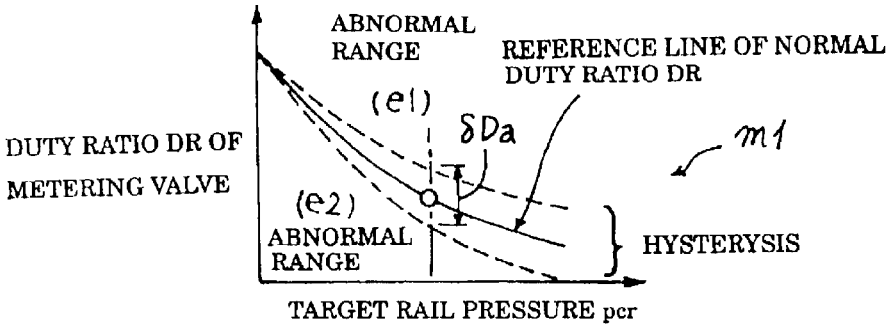
FIG. 3 shows a map showing characteristics of a duty ratio and a target rail pressure pcr.

In step b2, it is checked whether or not the duty ratio DR corresponding to the current target rail pressure pcr is equal to the normal reference duty ratio line or within the allowable range thereof, using the metering valve duty ratio DR vs. the target rail pressure pcr map m1 shown in FIG. 3.

The map m1 is designed in such a manner that the allowable deviation range is enlarged in response to the increase of the target rail pressure pcr. Further, the more the target common rail pressure pcr increases, the more the fuel pressure varies, and the more the pulse interval varies. Therefore, the determination range is designed to be large in order to assure the reliable and stable control operation.

The engine is determined to operate normally when the duty ratio DR is within the allowable range, so that the current control process is completed. Then, the process proceeds to step s3 (in the troubleshooting routine).

If the duty ratio DR is large with respect to the allowable range (i.e. open side e1), much fuel is returned and consumption of fuel stored in the common rail is small, the process proceeds to step b3, where the trouble flag Flga is set to "1". On the other hand, if the duty ratio DR is small with respect to the allowable range (i.e. closed side e2), little fuel is returned and consumption of fuel in the common rail is large, the process proceeds to step b4, where the trouble flag Flgb is set to "1". Then, the process returns to step s3 (in the troubleshooting routine).

In step s3, the pressure elevating mechanism 21 is stopped if the trouble flag FlgA, FlgB, Flga or Flgb is "1" and the pressure elevating mechanism 21 is abnormal. In this state, the low pressure fuel injecting system is operated using the fuel stored in the common rail 6. In this state, only the fuel pressure in the common rail 6 is increased or decreased so that the vehicle is running in the limp mode.

For instance, the combination of the trouble flag FlgA (excessive fuel injection) and the trouble flag Flgb (excessive consumption of fuel stored in the common rail) represents abnormal pressure-feeding in the pressure elevating piston due to cracking in the flow rate regulating orifice 47. Refer to FIG. 4. The combination of the trouble flag FlgB (inadequate fuel injection) and the trouble flag Flgb represents that excessive fuel leaks to the open path 30 due to the non-closure of the pressure elevating electromagnetic valve 25 or the pressure elevating piston does not function properly due to an increased clearance in a sliding part thereof. Further, the combination of the trouble flag FlgB and the trouble flag Flga (inadequate consumption of fuel stored in the common rail) represents the malfunction of the pressure elevating piston due to the increased clearance in the sliding part thereof.

Thereafter, the process proceeds to step s4 of the troubleshooting routine. In step s4, the control process is switched over to a process where the engine is operating in a range E1 depending upon the common rail pressure and the engine speed shown in FIG. 5(A). In order to suppress the decrease of the common rail pressure, the control process is switched over to a process where the engine is operating in a range E2 shown in FIG. 5(B). In short, the engine is operating in the limp mode in order to prevent excessive increase of injected fuel.

The pressure elevating mechanism 21 is stopped in order to avoid the malfunction of the engine body or the vehicle. Further, the low pressure fuel injecting system is made to operate using fuel stored in the common rail 6, which enables the vehicle to safely and quickly drive to a repair plant. In this case, the vehicle can move without excessive load to the engine and increase of exhaust gas temperature.

In step s3 of the troubleshooting routine, it is checked whether or not the pressure elevating mechanism 21 is functioning normally. If the pressure elevating mechanism 21 is found to be malfunctioning, it is stopped, thereby controlling the pressure of fuel in the common rail 6 and the amount of fuel injected in response to the operation of the injector electromagnetic valve 8. In this case, the suspension of the pressure elevating mechanism 21 is effective in avoiding vibrations caused by torque variations in the engine, and the engine is operated by the low pressure fuel injecting system using low pressure fuel, which enables the vehicle to safely and quickly drive to the repair plant. It is possible to suppress excessive load to the engine and increase of exhaust gas temperature.

Figure 5B:
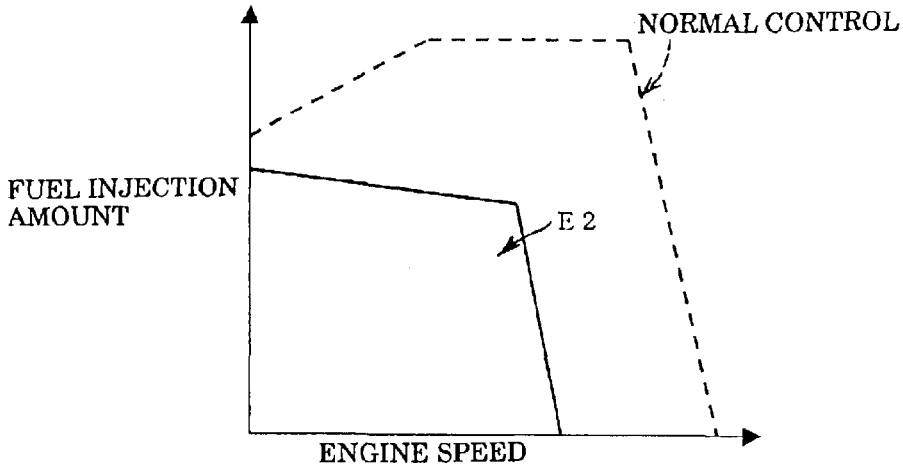
FIG. 5(B) shows control characteristics of fuel injection amount and engine speed, used for the pressure-elevating type fuel injecting system to perform troubleshooting.

In the common rail pressure and engine speed controlling range E1 shown in FIG. 5(A), the engine speed is suppressed and the common rail pressure is set to be relatively high compared to those in the normal rail pressure range. In the injection amount and engine speed controlling range E2 in FIG. 5(B), both the engine speed and the fuel injection amount are suppressed compared to those in the normal rail pressure range. These states are described with reference to a control routine for uninterrupted drive. In step c1, a current engine speed is downloaded. Next, in step c2, a common rail pressure Pmax corresponding to the engine speed shown in FIG. 5(A) is set. Specifically, opening and closing periods of the metering valve 45 are controlled so that the pressure in the pressure accumulating chamber is equal to the common rail pressure Pmax. In step c3, the fuel injection amount is set to be in the fuel injection amount range E2 shown in FIG. 5(B).

Fuel stored in the common rail 6 is adjusted by the metering valve 45 to the maximum allowable pressure (i.e. to a target control line Pmax in FIG. 5(A)), and is injected into the combustion chamber via the injectors. In this state, the vehicle can safely and quickly drive to the repair plant without smokes, excessive load to the engine and increase of exhaust gas temperature. Therefore, the vehicle can be protected against damages caused even when the engine keeps on operating under an abnormal state.

The pressure elevating mechanism is easily and appropriately determined to be malfunctioning if the crank pulse interval Tn excessively varies with the operating state of the engine and if the deviation δ D of the actual duty ratio DR (opening-closing signal) is above the allowable δ Da. As a result, it is possible to protect the engine against vibrations and to avoid inadequate purification of exhaust gas.

In the troubleshooting routine, the crank angle pulse interval is confirmed in step s1, and the duty ratio of the metering valve 45 is then confirmed in step s2. Alternatively, the troubleshooting routine may be simplified by executing step s1 or s2, and then executing steps s3 and s4.

What is claimed is:

1. A pressure-elevating type fuel injecting system in which high pressure fuel from a pressure accumulating chamber is further pressurized by a pressure-elevating mechanism and is injected into combustion chambers by injectors, the pressure-elevating type fuel injecting system comprising:

a crank angle sensor producing crank pulse signals in accordance with operating states of an engine;

a pulse interval calculating unit calculating pulse intervals between respective crank pulse signals; and a determination unit determining that the pressure elevating mechanism is malfunctioning when variations of the pulse intervals exceed a determination threshold.

2. The fuel injecting system of claim 1, further comprising a unit suspending the operation of the pressure elevating mechanism when the determination unit determines the malfunction of the pressure-elevating mechanism.

3. The fuel injecting system of claim 1, wherein the determination unit determines the pressure-elevating mechanism to be malfunctioning when crank pulse intervals depending upon engine states remain abnormal longer than a preset time period.

4. A pressure-elevating type fuel injecting system in which high pressure fuel from a pressure accumulating chamber is further pressurized by a pressure-elevating mechanism and is injected into combustion chambers by injectors, the pressure-elevating type fuel injecting system comprising:

a fuel supply pump supplying fuel to the pressure accumulating chamber;

a pressure regulating unit regulating fuel pressure in the pressure accumulating chamber by opening or closing a metering valve disposed in a fuel return path of the fuel supply pump;

a crank angle sensor producing crank pulse signals in accordance with operating states of an engine;

a pulse interval calculating unit calculating pulse intervals between adjacent crank pulse signals;

an opening-closing signal deviation calculating unit calculating deviations between actual opening-closing signals of the metering valve and a reference opening-closing signal corresponding to a target fuel pressure in the pressure accumulating chamber; and a determination unit determining that the pressure elevating mechanism is malfunctioning when variations of the pulse intervals exceed a determination threshold, and the calculated deviation of the opening-closing signal exceeds an allowable deviation range.

5. The fuel injecting system of claim 4, further comprising a unit suspending the operation of the pressure elevating mechanism when the determination unit determines the malfunction of the pressure elevating mechanism.

6. The fuel injecting system of claim 4, further comprising a fuel injecting unit injecting fuel to the combustion chamber by regulating pressure of fuel in the pressure accumulating chamber to an allowable maximum pressure through the operation of the metering valve when the determination unit determines the pressure-elevating mechanism to be malfunctioning.

7. The fuel injecting system of claim 4, further comprising a fuel injecting unit injecting fuel to the combustion chamber by regulating pressure of fuel in the pressure accumulating chamber to an allowable maximum pressure through the operation of the metering valve and by regulating an amount of injected fuel when the determination unit determines the pressure-elevating mechanism to be malfunctioning.

8. The fuel injecting system of claim 4, wherein the allowable deviation range is increased in accordance with an increase of the target fuel pressure in the pressure accumulating chamber.

9. A troubleshooting method for a pressure-elevating type fuel injecting system in which high pressure fuel from a pressure accumulating chamber is further pressurized by a pressure-elevating mechanism and is injected into combustion chambers by injectors, the method comprising:

calculating pulse intervals between respective crank pulse signals;

calculating an average of pulse intervals of a preset number of pulses;

calculating variations of the average of pulse intervals;

determining whether or not the variations are above a reference value;

determining whether or not the variations remain above the reference value longer than a preset time period; and determining that the pressure elevating mechanism is malfunctioning when the variations are determined to be above the reference value for the preset time period.

10. The method of claim 9, further comprising:

detecting a reference opening-closing signal corresponding to a target fuel pressure in the pressure accumulating chamber, and an actual opening-closing signal for the metering valve when the pressure elevating mechanism is determined to be malfunctioning;

determining whether or not the actual opening-closing signal is within the allowable range; and determining that the pressure elevating mechanism is malfunctioning when the actual opening-closing signal is out of the allowable range.

11. The method of claim 9, further comprising:

detecting an engine speed when the pressure elevating mechanism is determined to be malfunctioning;

regulating the fuel pressure in the pressure accumulating chamber to a preset maximum allowable pressure which depends upon the engine speed; and regulating a fuel injection amount in accordance with the engine speed.

* * * * *